US009149397B2

(12) United States Patent
Gallingani et al.

(10) Patent No.: US 9,149,397 B2
(45) Date of Patent: Oct. 6, 2015

(54) WHEELCHAIR LIFT

(71) Applicant: Autolift S.r.l., Pegognaga-Mantova (IT)

(72) Inventors: Marco Gallingani, Castelnovo di Sotto (IT); Gabriele Ovi, Reggio Nell'Emilia (IT)

(73) Assignee: Autolift S.r.l., Pegognaga-Mantova (IT)

( * ) Notice: Subject to any disclaimer, the term of this patent is extended or adjusted under 35 U.S.C. 154(b) by 135 days.

(21) Appl. No.: 14/045,927

(22) Filed: Oct. 4, 2013

(65) Prior Publication Data

US 2014/0105711 A1 Apr. 17, 2014

(30) Foreign Application Priority Data

Oct. 5, 2012 (EP) ..... 12187484

(51) Int. Cl.
*A61G 3/06* (2006.01)

(52) U.S. Cl.
CPC . *A61G 3/062* (2013.01); *A61G 3/06* (2013.01)

(58) Field of Classification Search
CPC ..... A61G 3/062; A61G 3/06; A61G 3/08; A61G 3/0808; A61G 2203/723; B60P 1/483; B60P 1/4421; B60P 1/4442; B66B 9/0853
See application file for complete search history.

(56) References Cited

U.S. PATENT DOCUMENTS

| | | | | |
|---|---|---|---|---|
| 4,408,948 | A * | 10/1983 | Robinson | 414/545 |
| 6,379,102 | B1 * | 4/2002 | Kameda | 414/546 |
| 6,971,834 | B2 * | 12/2005 | Morris | 414/539 |
| 7,491,026 | B2 * | 2/2009 | Hooker | 414/545 |
| 2013/0251489 | A1 * | 9/2013 | Bruns | 414/546 |
| 2014/0377047 | A1 * | 12/2014 | Gallingani | 414/546 |

FOREIGN PATENT DOCUMENTS

| | | | |
|---|---|---|---|
| WO | 99/60976 | A1 | 12/1999 |
| WO | WO 03059685 | A2 * | 7/2003 |

* cited by examiner

*Primary Examiner* — Kaitlin Joerger
(74) *Attorney, Agent, or Firm* — Collard & Roe, P.C.

(57) ABSTRACT

A wheelchair lift includes a platform assembly to receive a wheelchair and a power control assembly to control a movement of the platform assembly between an unfolded configuration and a folded configuration. The platform assembly includes an inner plate and an outer plate, wherein the inner plate is pivotably coupled to a holding arm by a hinge element and the outer plate is pivotably coupled to the inner plate. The wheelchair lift further includes a linkage assembly having a first end coupled to the outer plate and a second end (52), and a fixing element being coupled to the inner plate such that the fixing element is moved with a rotational movement of the inner plate around the hinge element, when the inner plate is moved between the folded and the unfolded configuration, wherein the second end of the linkage assembly is coupled to the fixing element.

13 Claims, 9 Drawing Sheets

WHEELCHAIR LIFT

CROSS REFERENCE TO RELATED APPLICATIONS

Applicant claims priority under 35 U.S.C. §119 of European Application No. 12187484.6 filed Oct. 5, 2012, the disclosure of which is incorporated by reference.

BACKGROUND OF THE INVENTION

1. Field of the Invention

The invention is directed to a wheelchair lift which enables to lift a wheelchair from a ground level position to an entry level position in a vehicle and inversely.

2. Description of the Related Art

Vehicular wheelchair lifts are utilized to facilitate lifting of wheelchairs into a vehicle. The wheelchair lift comprises a platform assembly to load a wheelchair. The wheelchair may be moved by the lift among a stowed position in which plates of the platform assembly are in a folded configuration inside the vehicle, an entry level position in which the plates of the platform assembly are unfolded so that the wheelchair can be loaded onto the platform assembly in the vehicle and a ground level position in which the platform assembly is still unfolded and coplanar to the ground outside the vehicle.

The wheelchair lift may be constructed such that inner and outer plates of the platform assembly are automatically moved from the folded configuration to the unfolded configuration when the platform assembly is moved from the stowed position to the entry level position. In the same way the inner and outer plates of the platform assembly are collapsed when the platform assembly is moved from the entry level configuration to the stowed configuration.

It is desirable to design the wheelchair lift such that the folding and unfolding processes of the inner and outer plates of the platform assembly are accomplished by a continuous and slow movement of the inner and outer plates.

SUMMARY OF THE INVENTION

An embodiment of a wheelchair lift enabling a smooth motion of the inner and outer plates of the platform assembly according to the invention is set forth below.

According to a possible embodiment the wheelchair lift comprises a platform assembly to receive a wheelchair, a power control assembly to control a movement of the platform assembly between an unfolded configuration and a folded configuration. The wheelchair lift further comprises a holding arm to movably hold the platform assembly. The platform assembly comprises an inner plate and an outer plate, wherein the inner plate is pivotably coupled to the holding arm by a hinge element and the outer plate is pivotably coupled to the inner plate. The wheelchair lift comprises a linkage assembly having a first end coupled to the outer plate and a second end. The wheelchair lift further comprises a fixing element being coupled to the inner plate such that the fixing element is moved with a rotational movement of the inner plate around the hinge element, when the inner plate is moved between the folded and the unfolded configuration. The second end of the linkage assembly is coupled to the fixing element.

The coupling between the inner plate and the fixing element is arranged such that the coupling causes the movement of the fixing element together with the rotational movement of the inner plate. The fixing element may be coupled to the inner plate such that the rotational movement of the inner plate around the hinge element which couples the platform assembly to the holding arm may cause the movement of the fixing element. The fixing element may be coupled to the inner plate such that the movement of the fixing element causes the rotational movement of the inner plate.

The linkage assembly enables to unfold the inner and outer plates of the platform assembly by a slow and continuous movement of the inner and the outer plates around another hinge element of the platform assembly at which the inner and outer plates are pivotably connected. The inner plate is continuously moved around the hinge element which pivotably connects the inner plate to the holding arm.

The linkage assembly may comprise a rope or a chain which is fixed at one of its end sections to the outer plate and with the other of its end sections to the fixing element. The rope or the chain may be made of metal or steel or any other flexible material like aramide fiber or aramide fiber composition. The rope or the chain is led from the outer plate via at least one deflecting element towards the fixing element. According to another embodiment the linkage assembly comprises some rigid elements which are pivotably connected by hinge elements, wherein an end section of one of the rigid elements is fixed to the outer plate and an end section of another one of the rigid elements is connected to the fixing element.

The outer plate may comprise a first end proximal to the hinge element of the platform assembly and a second end distal to the hinge element of the platform assembly. The inner plate may comprise a first end distal to the hinge element of the platform assembly and a second end proximal to the hinge element of the platform assembly. A first end of the linkage assembly may be fixed to the first end of the outer plate and a second end of the linkage assembly may be rotatably fixed to the first end of the inner plate.

The outer plate may respectively comprise a side panel which is provided at sides of a platform of the outer plate on which the wheelchair may be loaded. The first end of the linkage element may be fixed to the side panel of the outer plate. The first end of the linkage element may be fixed in a hole of the side panel or by a pivot which may be mounted to the side panel.

According to a possible embodiment the fixing element may comprise a pivot mounted to the first end of the inner plate, wherein the second end of the linkage element is fixed to the pivot. According to another embodiment the fixing element may be formed as a hole in the material of the inner plate at the first end of the inner plate and the second end of the linkage assembly is fixed at the hole by leading the rope or chain as a slope through the hole. The inner plate may comprise a platform to load the wheelchair and side panels mounted on both sides of the platform of the inner plate. The fixing element may be provided at the side panel of the inner plate. The pivot may be fixed to the side panel or the hole may be provided in the material of the side panel.

The wheelchair lift may comprise a lifting assembly being connected to the power control assembly and the holding arm. The wheelchair lift may comprise an elbow assembly having a first arm which is pivotably coupled to the inner plate of the platform assembly and a second arm which is pivotably coupled to the holding arm. The elbow assembly may further comprise a hinge element at which the first and second arms of the elbow assembly are pivotably connected. The wheelchair lift is arranged such that the hinge element of the elbow assembly is coupled to the lifting assembly in such a way that the lifting assembly touches the hinge element when moving the platform assembly from the folded configuration in the stowed position to the unfolded configuration in the entry level position. The hinge element of the elbow assembly is decoupled from the lifting assembly when moving the platform assembly from the entry level position to the ground level position.

The linkage assembly may be coupled to the first arm of the elbow assembly by means of at least one first deflecting unit. The first deflecting unit is arranged to deflect the linkage assembly, particularly a steel rope or a chain, from a fixing point at the outer plate of the platform assembly to the fixing element mounted at the inner plate of the platform assembly.

According to another embodiment the first deflecting unit may comprise a first and a second deflecting element coupled to the first arm of the elbow assembly. The first deflecting element is positioned closer to the hinge element of the elbow assembly than the second deflecting element. The linkage assembly is led from the outer plate to the first deflecting element which deflects the linkage assembly towards the second deflecting element. The second deflecting element deflects the linkage assembly towards the fixing element which is mounted to the inner plate.

The first deflecting element is positioned between the hinge element of the elbow assembly and the second deflecting element such that the first deflecting element tightens the linkage assembly, for example the steel rope or the chain or the rigid elements, when the inner and outer plates of the platform assembly are moved to the unfolded configuration. The first deflecting element is positioned between the hinge element of the elbow assembly and the second deflecting element such that the linkage assembly, for example the steel rope or the chain or the rigid elements, is in a loose state when the inner and outer plates of the platform assembly are collapsed in the stowed configuration of the platform assembly. The first deflecting element may be formed as a roll or a pulley.

The first arm of the elbow assembly may be coupled to the inner plate of the platform assembly by a pivot pin fixed to the inner plate. The second deflecting element may be fixed to the pivot pin. The second deflecting element may be moved together with the movement of the inner plate. The second deflecting element may also be formed as a roll or a pulley or an extender device or may be configured in the shape of one half of a wheel.

According to a further embodiment of the wheelchair lift the fixing element may be fixed to the pivot pin which connects the first arm of the elbow assembly to the inner plate. The pivot pin rotates together with the movement of the inner plate of the platform assembly around the holding arm when swinging open the platform assembly. The fixing element may be firmly connected to the pivot pin so that the fixing element is moved together with the movement of the inner plate of the platform assembly. By fixing the second end of the linkage assembly, for example the steel rope or the chain or the rigid elements, to the fixing element the rotational movement of the fixing element tightens the linkage assembly during the unfolding process of the inner and outer plates of the platform assembly. During the folding process the state of the linkage assembly is changed from a strained configuration to a loose configuration.

The first deflecting element of the first deflecting unit is positioned at the first arm of the elbow assembly such that the length between the fixing point of the fixing element and the second end of the outer plate at which the first end of the linkage assembly is fixed slightly changes. The linkage assembly is in a strained configuration when the inner and outer plates of the platform assembly are unfolded and in a loose configuration when the first and second plates of the platform assembly are unfolded. The difference in length between the fixing point at the fixing element and the fixing point at the outer plate is for example about less than 10 mm. The low difference in length enables that the inner and outer plates are unfolded in a low and continuous way and a sudden swing-down deployment motion of the inner and outer plates from the stowed position to the entry level position can be avoided.

It is to be understood that both the foregoing general description and the following detailed description present embodiments and are intended to provide an overview or a framework for understanding the nature and character of the disclosure. The accompanying drawings are included to provide a further understanding, and are incorporated into and constitute a part of this specification. The drawings illustrate various embodiments and, together with the description, serve to explain the principles and operation of the concepts disclosed.

DETAILED DESCRIPTION OF PREFERRED EMBODIMENTS

Figure 1:
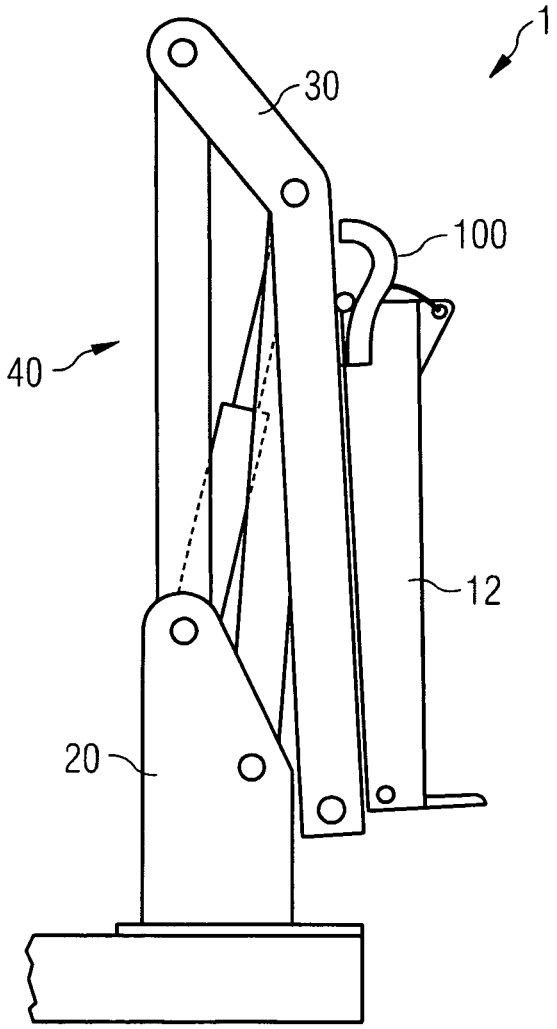
FIG. 1 shows an embodiment of a wheelchair lift with an unfolded platform in a stowed configuration.

FIGS. 1, 2, 3 and 4 show an embodiment of a wheelchair lift to raise a wheelchair from a ground level into a vehicle. The wheelchair lift comprises a platform assembly 10 with an inner plate 11 and an outer plate 12. The inner plate 11 may comprise a platform 1110 to load the wheelchair and a side panel 1120 for preventing the wheelchair from rolling off the sides of the inner plate 11. The outer plate 12 may comprise a platform 1210 to load the wheelchair and a side panel 1220 for preventing the wheelchair from rolling off the sides of the outer plate 12. The outer and inner plates are pivotably connected by a hinge element 13. An outer roll stop means 14 is mounted to an end 1202 of the outer plate. In a retracted position shown in FIG. 3 the outer roll stop means 13 prevents a wheelchair from rolling-off the front of the platform assembly when the platform assembly is lowered from the entry level position in a vehicle to the ground level position. The roll stop means may be hinged down in the ground level position so that a wheelchair can roll-off or enter the platform assembly.

Figure 2:
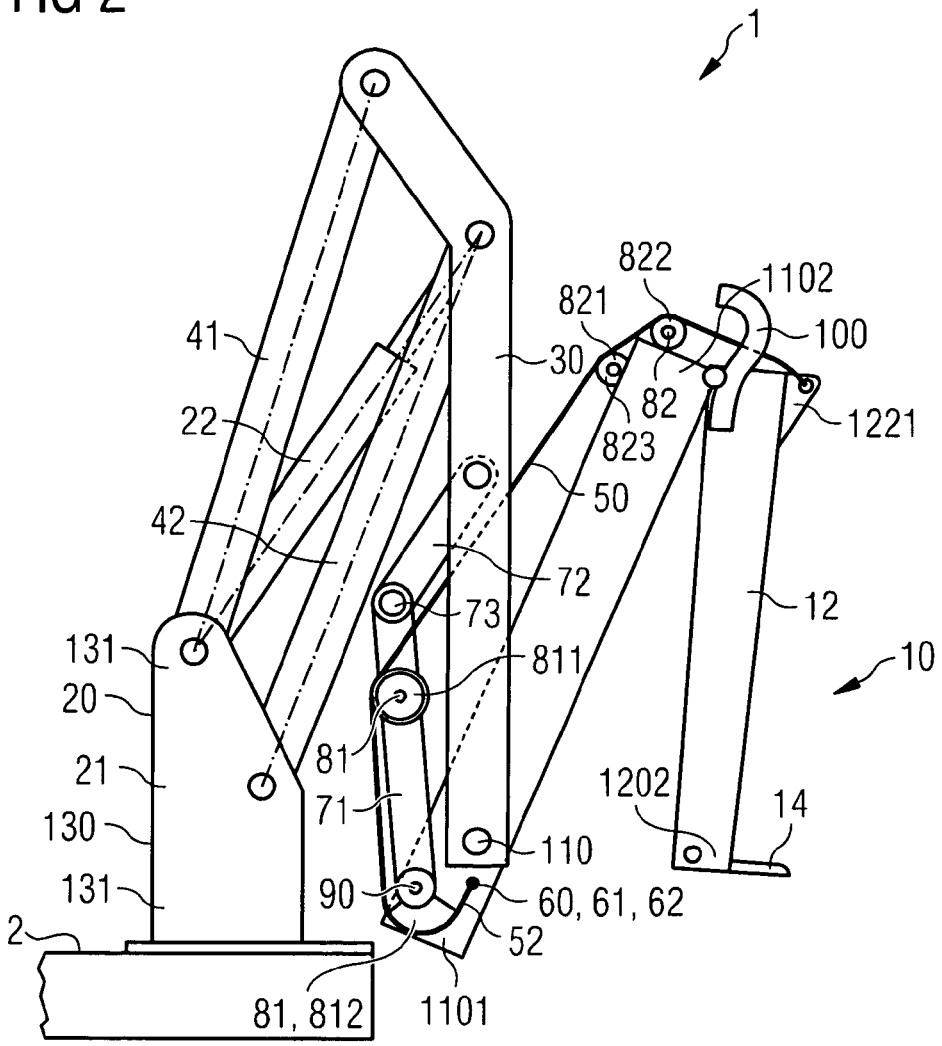
FIG. 2 shows an embodiment of a wheelchair lift during a process of unfolding the platform assembly.

The wheelchair lift further comprises a power control assembly 20 to control a movement of the platform assembly 10 among a stowed position in which the inner and outer plates of the platform assembly are collapsed as shown in FIG. 1, an entry level position in which the inner and outer plates of the platform assembly are in an unfolded configuration as shown in FIG. 2 and a ground level position in which the inner and outer plates of the platform assembly are unfolded and are moved to a level below the entry level.

Furthermore, the wheelchair lift comprises a holding arm 30 and a lifting assembly 40. The lifting assembly 40 comprises a parallelogram actuating linkage structure having a top actuating arm 41 and a bottom actuating arm 42 which are located substantially parallel to each other. Rear ends of the top and bottom actuating arms 41, 42 are pivotably connected to a front plate 131 of a housing 130 which includes the power control assembly 20. The parallelogram actuating structure 40 may be moved by a hydraulic actuating system comprising a hydraulic cylinder 22 mounted between the top and bottom actuating arm 41, 42 of the parallelogram actuating structure.

The holding arm 30 comprises an upper portion 31 and a lower portion 32 which may be formed as a unique part. The upper portion 31 of the holding arm is pivotably connected to a front end of the lifting assembly 40. The lower portion 32 of the holding arm which is formed as a substantially vertical arm is pivotably connected to the inner plate 11 of the platform assembly 10. The holding arm 30 may pivotably connected to the inner plate 11 by a hinge element 110. The inner plate 11 of the platform assembly is rotatably coupled to the holding arm by the hinge element. The hinge element 110 forms a rotational axis for the inner plate 11. The inner plate 11 performs a rotational movement around the hinge element 110.

The wheelchair lift further comprises a linkage assembly 50 which may comprise a steel rope or a chain or some rigid elements. The rigid elements may be formed as rods. The rigid elements may pivotably be connected by hinge elements. The linkage assembly may have an end 51 which is coupled to the outer plate 12. The end 51 of the linkage assembly may be coupled to the side panel 1220 of the outer plate 12 by a hole provided in the material of the side panel in which the end 51 of the linkage assembly may be fixed. According to another embodiment a pivot may be fixed in the hole of the side panel 1220 and the end 51 of the linkage assembly may be fixed at the pivot. The side panel 1220 may comprise a projection element 1221 at which the end 51 of the linkage assembly may be fixed.

Figure 3:
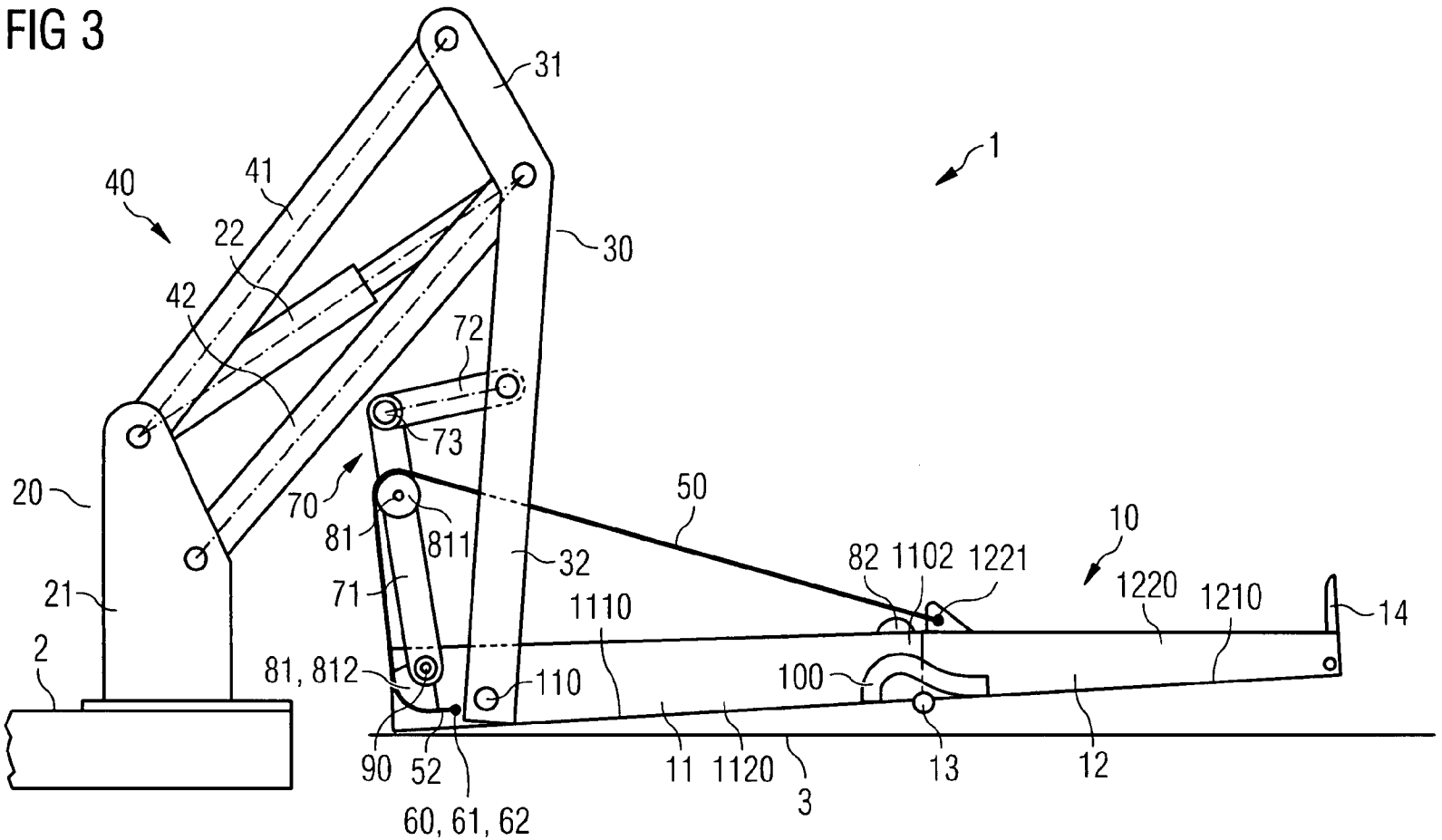
FIG. 3 shows an embodiment of a wheelchair lift with an unfolded platform assembly in an entry level position.

The wheelchair lift further comprises a fixing element 60 which may be coupled to the inner plate 11 of the platform assembly such that the fixing element 60 is moved together with the rotational movement of the inner plate 11 around the hinge element 110 when the inner plate is moved among the folded configuration shown in FIG. 1 and the unfolded configuration shown in FIG. 3. An end 52 of the linkage assembly 50 is coupled to the fixing element 60.

The wheelchair lift comprises an elbow assembly 70 having a lower arm 71 pivotably connected to the inner plate 11 of the platform assembly, an upper arm 72 pivotably coupled to the holding arm 30, and hinge element 73 at which the upper and the lower arms 71, 72 of the elbow assembly are pivotably connected. The elbow assembly may pivotably be connected to the side panel 1120 of the inner plate 11 by a pivot pin 90. The fixing element 60 may be coupled to the side panel 1120 of the inner plate 11 between the pivot pin 90 and the rotational axis 110 at which the inner plate 11 is rotatably coupled to the lower portion 32 of the holding arm 30.

According to the embodiments shown in FIGS. 1, 2, 3 and 4, the wheelchair lift comprises at least one deflecting unit 81 which is coupled to the elbow assembly 70. The at least one deflecting unit 81 is arranged to deflect the linkage assembly 50 from the outer plate 12 of the platform assembly to the fixing element 60. The deflecting unit 81 may comprise a deflecting element 811 and a deflecting element 812, wherein each of the deflecting elements 811, 812 are connected to the lower arm 71 of the elbow assembly. The deflecting element 811 is positioned closer to the hinge element 73 than the deflecting element 812. The linkage assembly, for example the steel rope or the chain or the rigid elements, is led from the outer plate 12 of the platform assembly to the deflecting element 811. The linkage assembly 50 is deflected at the deflecting element 811 from a direction coming from the outer plate 12 to a direction towards the deflecting element 812. The linkage assembly 50 is deflected at the deflecting element 812 from the direction coming from the deflecting element 811 towards the fixing element 60.

The fixing element 60 may be formed as a hole 61 in the inner plate 11 of the platform assembly. The end 52 of the linkage assembly may be fixed to the hole 61. According to another embodiment the fixing element 60 may comprise a pivot 62 which is mounted to the inner plate 11 of the platform assembly. The end 52 of the linkage assembly is fixed to the pivot 62. The fixing element may be disposed at the side panel 1120 of the inner plate. The hole may be provided in the material of the side panel 1120. The pivot may be mounted to the side panel 1120. The end 52 of the linkage assembly may be connected to the side panel 1120 of the inner plate 11 by the fixing element 60.

The deflecting element 811 may be arranged as a roll or pulley which is movably connected to the arm 71 of the elbow assembly. The deflecting element 812 may be formed as a roll or pulley which is pivotably connected to the inner plate 11 and primarily to the side panel 1120 of the inner plate 11. The deflecting element 812 may alternatively be shaped as one half of a wheel or an extender device connected to the inner plate 11 of the platform assembly. The linkage assembly is guided within a respective flute of each of the deflecting elements 811, 812. Each of the deflecting elements can alternatively be formed as an element fixed to the arm 71 of the elbow assembly, wherein the element enables the linkage assembly to glide around the deflecting element.

FIG. 1 shows an embodiment of the wheelchair lift 1 in the stowed configuration in which the inner and outer plates 11, 12 of the wheelchair assembly are collapsed. A bottom surface of the platform 1110 of the inner plate 11 abuts against a bottom surface of the platform 1210 of the outer plate 12 of the platform assembly. The inner plate 11 has a first end 1101 distal to the hinge element 13 and a second end 1102 proximal to the hinge element 13. The outer plate 12 has a first end 1201 proximal to the hinge element 13 and a second end 1202 distal to the hinge element 13. The end 51 of the linkage assembly is fixed to the first end of the outer plate 12.

The wheelchair lift may comprise an arrestor element 100. The arrestor element is movably connected to the end 1201 of the outer plate 12 of the platform assembly. In the stowed configuration of the platform assembly the arrestor element abuts on the holding arm 30 so that the foldable platform assembly is firmly held at the holding arm in the stowed configuration.

FIG. 2 shows the process of unfolding the inner and outer plates 11, 12 during a movement of the platform assembly between a stowed configuration of the platform assembly in which the bottom surfaces of the platforms of the inner and outer plates 11, 12 abuts each other and the entry level position in which the plates are unfolded and the upper surfaces of the platforms 1110, 1210 forms a continuous area to receive a wheelchair.

The power control assembly 20 moves the lifting assembly such that the arms 41, 42 of the parallelogram actuating linkage structure 40 decline from the vertical position shown in FIG. 1 to the substantially horizontal position shown in FIG. 3. The holding arm is moved down and the lower arm 42 of the parallelogram actuating linkage structure 40 is pressed to the elbow assembly 70 and particularly to the hinge element 73 so that the angle between the upper and lower arms 71, 72 of the elbow assembly is changed. The lower arm 72 of the elbow assembly which is coupled to the first end 1101 of the inner plate 11 pushes against the first end 1101 of the inner plate which causes that the inner plate 11 is swung down around the hinge element 110 at which the inner plate is pivotably connected to the holding arm 30. The inner plate 11 of the platform assembly 10 declines and causes an unfolding of the inner and outer plates 11, 12. The inner and outer plates 11, 12 of the platform assembly swing open until the entry level positioned shown in FIG. 3 is reached.

The linkage assembly 50 facilitates the swing-down deployment motion of the inner and outer plates 11, 12. In the stowed configuration the linkage assembly 50, for example the steel rope or the chain or the rigid elements, are loosely guided via the deflecting elements 811, 812 between the first end 1201 of the outer plate 12 and the fixing element 60 at the first end of the inner plate 11. During the swinging-down movement of the platform assembly the linkage assembly 50 is strained so that the linkage assembly enables a low and continuous movement of the inner and outer plates 11, 12 during the unfolding procedure. The deflecting element 811 is connected to a position at the lower arm 71 of the elbow assembly 70 so that the difference in length between the fixing position at the first end 1201 of the outer plate 12 and the fixing position at the fixing element 60 is small, for example less than 10 mm.

In order to lead the linkage assembly 50 from the side panel 1220 and particularly form the projection element 1221 of the side panel 1220 to the deflecting unit 81, the wheelchair lift may comprise a deflecting unit 82. The deflecting unit 82 may be pivotably coupled to the end 1102 of the inner plate 11 and particularly to the side panel 1120 at the end 1102 of the inner plate 11. The deflecting unit 82 is arranged to support a deflecting of the linkage assembly from the fixing area at the side panel 1220 or the projection element 1221 towards the deflecting unit 81 at the elbow assembly.

As shown in FIG. 2, the linkage assembly is particularly guided via the deflecting unit 82 during the unfolding process of the inner and outer plates. The deflecting unit 82 may comprise a first deflecting element 821 and a second deflecting element 822 which are coupled together at a connecting element 823. The connecting element may pivotably be connected to the side panel 1120 of the inner plate. During the unfolding process the deflecting elements 821, 822 change their position in relation to the inner plate 11 so that the linkage assembly bears on both of the deflecting elements 821, 822. Each of the deflecting elements 821, 822 may comprise a roll which is mounted to the connecting element 823.

Figure 4:
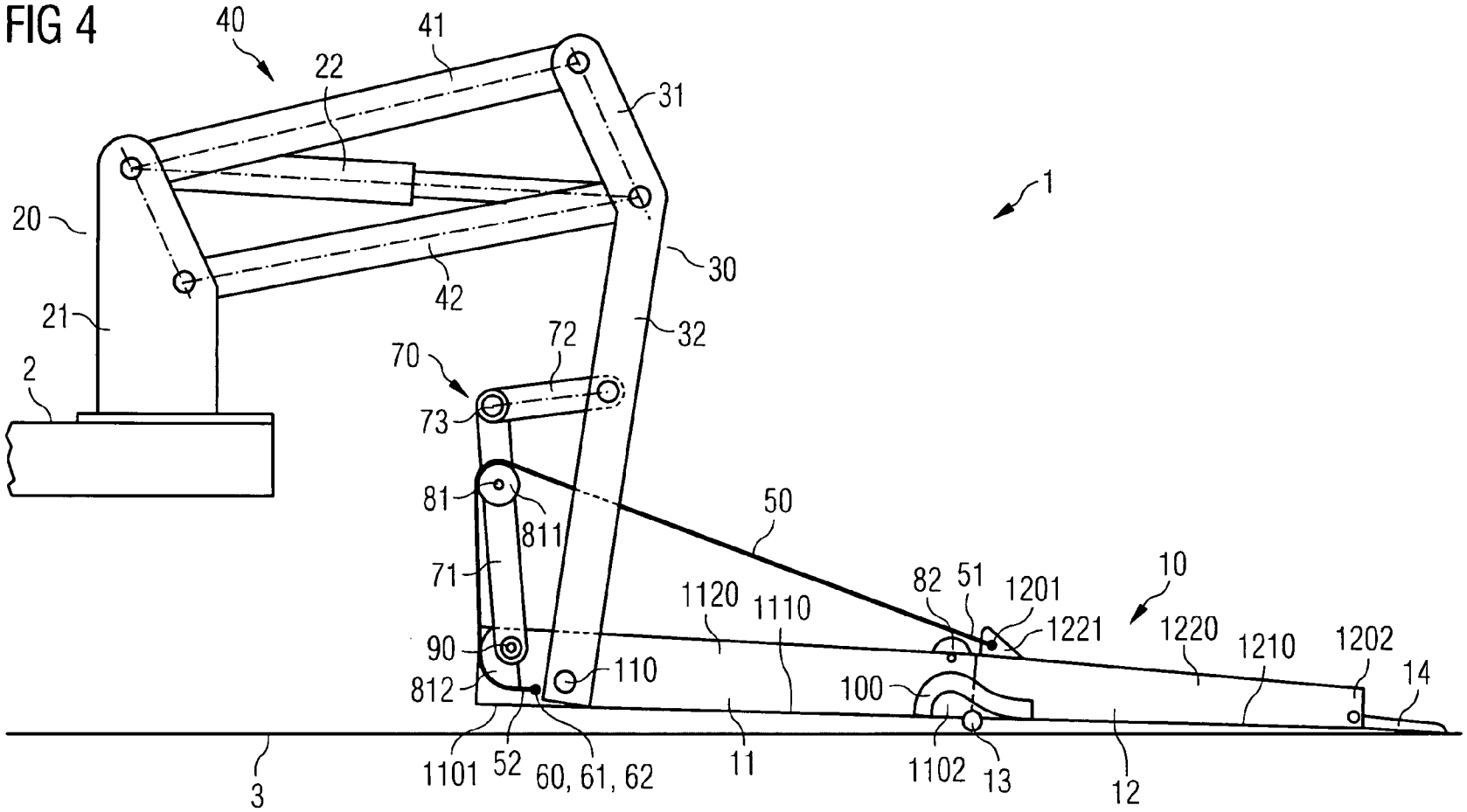
FIG. 4 shows an embodiment of a wheelchair lift with a folded platform assembly in a ground level position.

FIG. 3 shows the wheelchair lift when the platform assembly is fully unfolded and the bottom surfaces of the platforms 1110, 1210 of the inner and outer plates 11, 12 of the platform assembly contact a floor 2, for example a floor in a vehicle. In order to put down the wheelchair to a ground level outside the vehicle the power control assembly 20 slants the lifting assembly 40 anymore so that the unfolded platform assembly 10 is moved by the holding arm 30 from the entry level position to the ground level position 3 which is below the entry level position as shown in FIG. 4.

Figure 5:
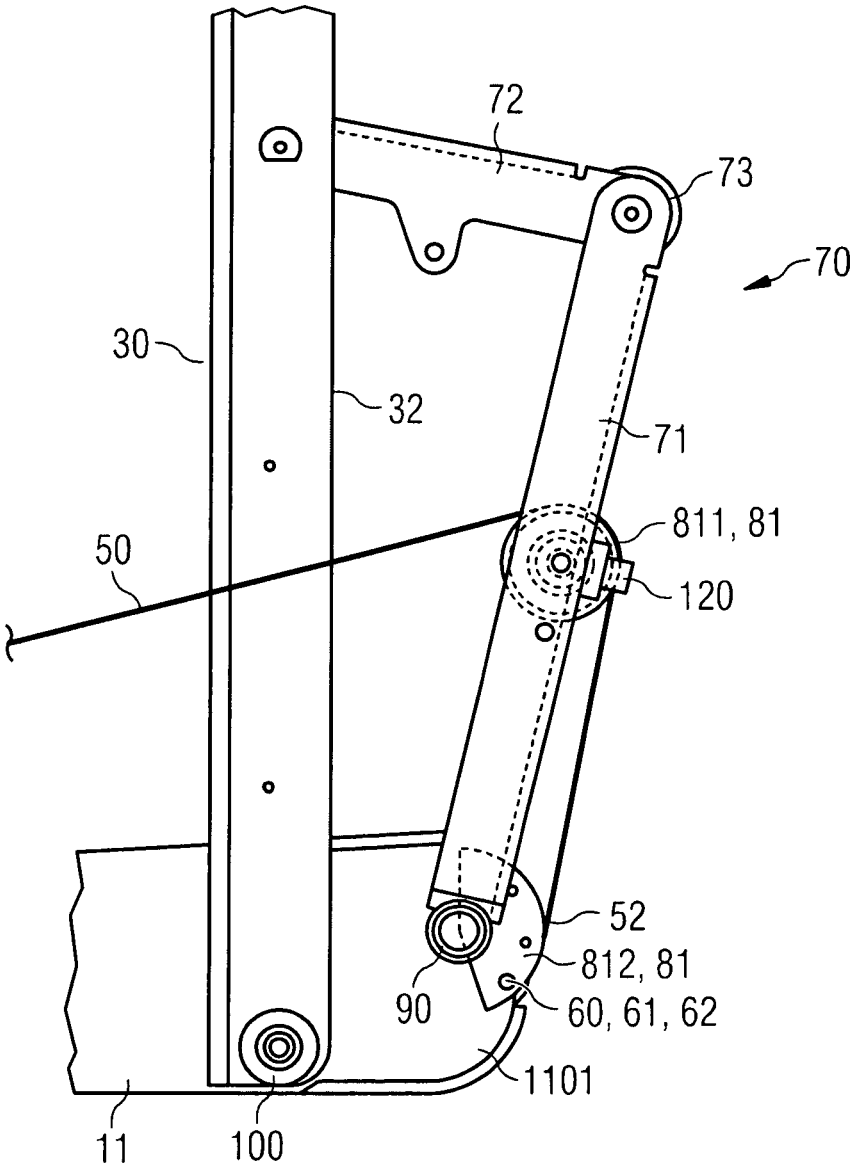
FIG. 5 shows an embodiment of coupling a linkage assembly to a movement of an inner plate of a platform assembly in greater detail.
Figure 6:
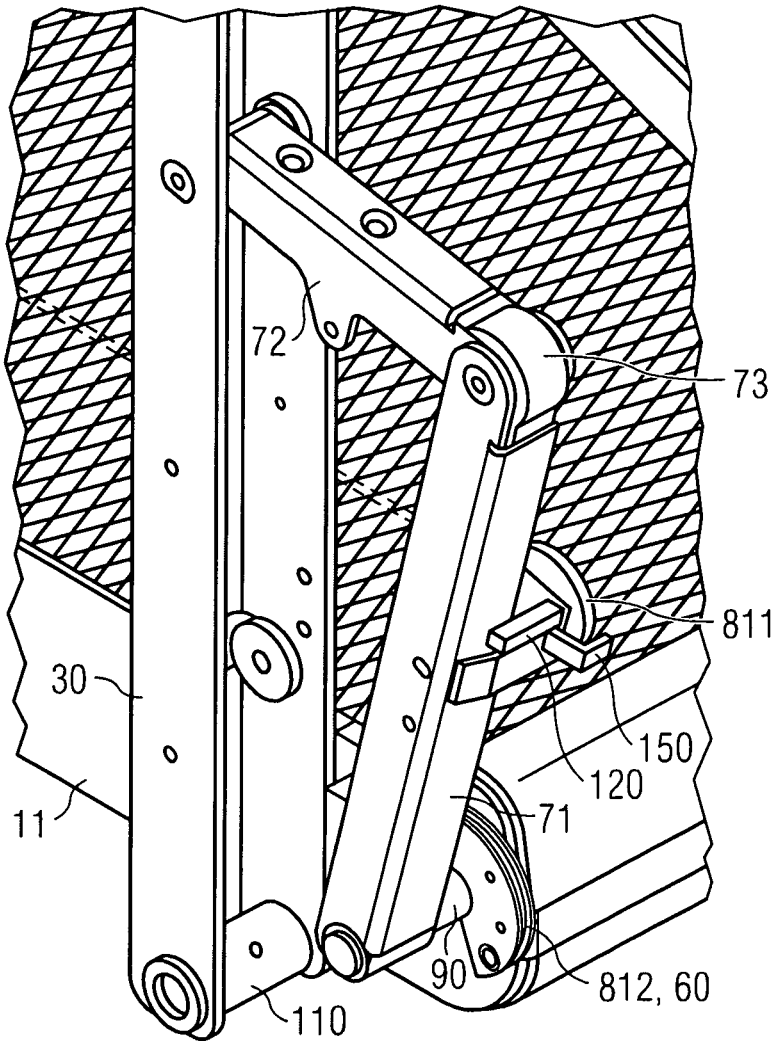
FIG. 6 shows a perspective view of an elbow assembly coupled to a holding arm and an inner plate of a platform assembly.

FIG. 5 shows another embodiment of the wheelchair lift and particularly an embodiment of the inner plate 11 of the platform assembly, the holding arm 30, the linkage assembly 50 and the elbow assembly 70 in greater detail. FIG. 6 shows the embodiment of the wheelchair lift without the linkage assembly 50 in a perspective view. The deflecting element 811 is connected by a supporting element 120 to the lower arm 71 of the elbow assembly. The lower portion 32 of the holding arm 30 is coupled by an axis/hinge element 110 to the end 1101 of the inner plate 11 of the platform assembly. The rotational axis 110 enables that the inner plate 11 is pivotably coupled to the holding arm 30.

The upper arm 72 of the elbow assembly is pivotably coupled to the holding arm 30. The end 1101 of the inner plate 11 is connected to the lower part 71 of the elbow assembly by the pivot pin 90. The pivot pin 90 is fixed to the inner plate 11, so that the pivot pin 90 is moved by the rotational movement of the inner plate 11 of the platform assembly around the hinge element 110. The deflecting element 812 which may be formed as one half of a wheel or as an extender wheel is fixed to the pivot pin 90 so that the deflecting element 812 is moved together with the movement of the inner plate 11 of the platform assembly. The linkage assembly is guided in respective flutes of the deflecting elements 811, 812 towards the fixing element 60. In order to prevent the linkage assembly from jumping-off the deflecting elements, a protection element 150 may be disposed above the flute of the deflecting elements as shown for the deflecting element 81.

According to another embodiment the deflecting element 812 may be used as fixing element 60. In this case the fixing element 60 is fixed at the pivot pin 90. The fixing element 60 may be formed as one half of a wheel or as an extender wheel. The fixing element may comprise at least one hole 61 to directly fix the end 52 of the linkage assembly 50. The fixing element may comprise a pivot 62 mounted to the hole 61. The end 52 of the linkage assembly may be fixed to the pivot 62. Due to the firm coupling between the fixing element 60 and the axis of the pivot pin 90 the fixing element 60 is moved by the swing-down deployment motion of the inner plate 11.

The linkage assembly 50 is fixed with its first end 51 at the side panel 1220 at the first end 1201 of the outer plate 12 and with its second end 1202 at the fixing element 60 such that the linkage assembly 50 is loosely held between the fixing element 60 and the end 1201 of the outer plate 12. During the swing-down deployment motion of the platform assembly from the stowed position to the entry level position to unfold the two plates 11, 12 of the platform assembly into a substantially horizontal position and coplanar to each other the linkage assembly 50 is slowly tightened. The tightening of the linkage assembly enables a slow and continuous swing-down deployment motion of the inner and outer plates 11, 12 of the platform assembly. During folding and unfolding the platform is driven by a rope, a chain or rigid elements that are constantly kept at the right length and tension in order to have s slow and therefore better controlled movement of the platform assembly.

Figure 7:
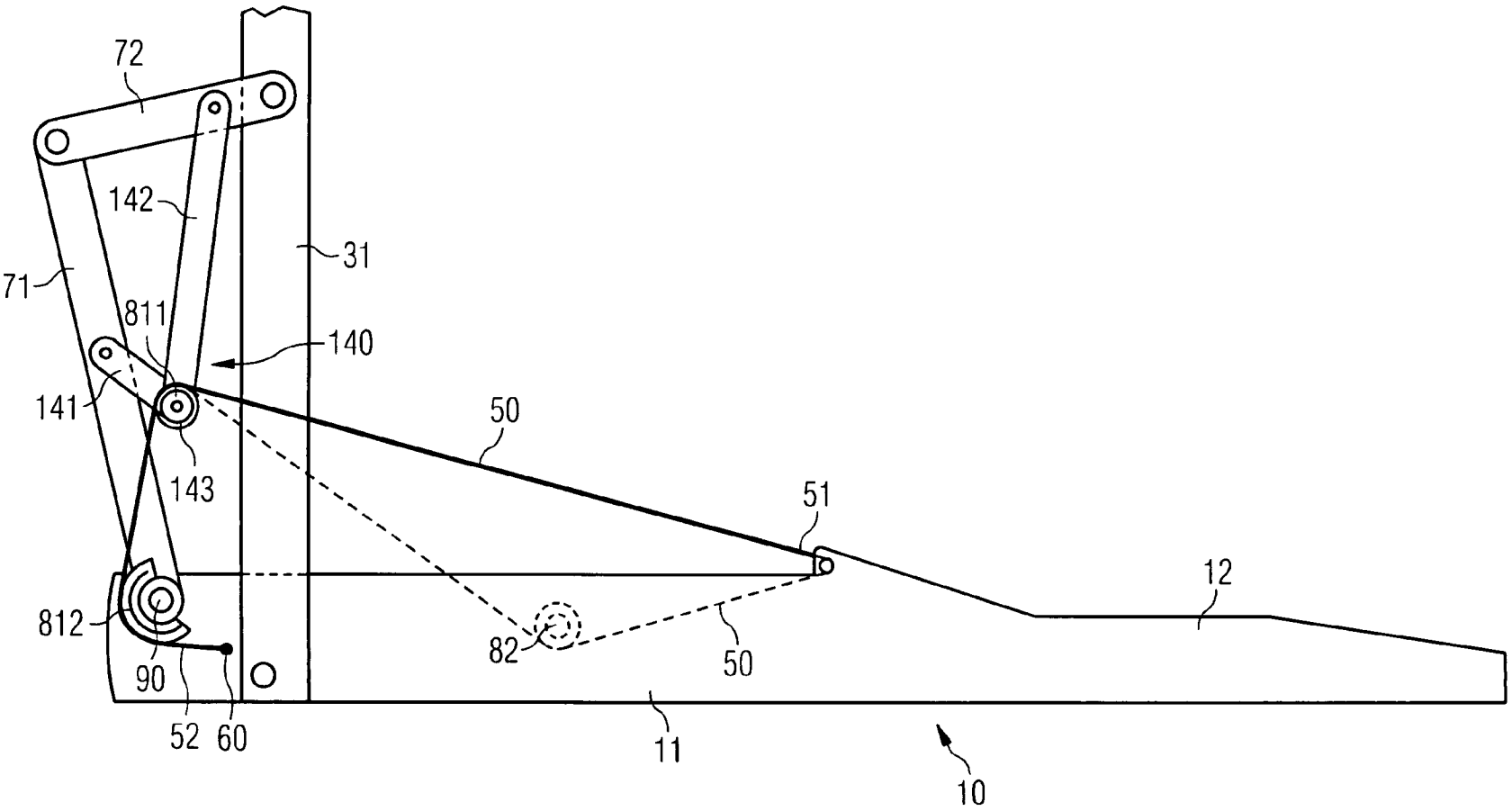
FIG. 7 shows an embodiment of a wheelchair lift with a foldable platform assembly.

FIG. 7 shows another embodiment of the wheelchair lift. FIG. 7 illustrates the inner and outer plates 11 and 12 of the platform assembly 10, the lower portion 32 of the holding arm 30 and the elbow assembly 70 comprising the arms 71, 72 coupled by the hinge element 73. The embodiment of the wheelchair lift also comprises the power control assembly 20 and the lifting assembly 40 which are not shown in FIG. 7 due to reasons of simplification. The wheelchair lift comprises a further elbow assembly 140. The further elbow assembly 140 is coupled to the elbow assembly 70 and comprises an arm 141 being pivotably coupled to the arm 71 of the elbow assembly 70 and an arm 142 being pivotably coupled to the arm 72 of the elbow assembly 70. The further elbow assembly 140 comprises a hinge element 143 for movably coupling the arms 141, 142. The linkage assembly 50 is fixed with an end 51 at the outer plate 12 and with the other end 52 at the fixing element 60. The fixing element 60 is mounted to the inner plate 11.

The wheelchair lift further comprises a deflecting unit 81 comprising a first and a second deflecting element 811, 812, wherein the first deflecting element 811 is coupled to the hinge element 143 of the further elbow assembly 140. The arm 71 of the elbow assembly 70 is movably coupled to the inner plate 11 by the pivot pin 90. The deflecting element 812 of the deflecting unit 81 is fixed to the pivot pin 90. The linkage assembly 50 is led from the outer platform 12 to the deflecting element 811. The linkage assembly 50 is deflected at the deflecting element 811 towards the deflecting element 812. The linkage assembly 50 is deflected at the deflecting element 812 towards the fixing element 60.

According to another embodiment the pivot pin 90 may be fixed to the inner plate 11 and the fixing element 60 may be fixed to the pivot pin 90. The deflecting unit 81 may comprise only the deflecting element 811 which is coupled to the hinge element 143. The linkage assembly 50 is led from the outer platform 12 to the deflecting unit 81, i.e. the deflecting element 811. The linkage assembly 50 is deflected at the deflecting unit 81 directly towards the fixing element 60.

According to another embodiment the linkage assembly 50 is fixed to the outer plate 12 and led via a deflecting unit 82 to the deflecting unit 81. The linkage assembly is shown for this embodiment in FIG. 7 as a dashed line. The deflecting unit 82 may be arranged as a pulley and may be mounted to the inner plate 11. The linkage assembly 50 is deflected at the deflecting unit 81 towards the fixing element 60 as explained above.

Figure 8:
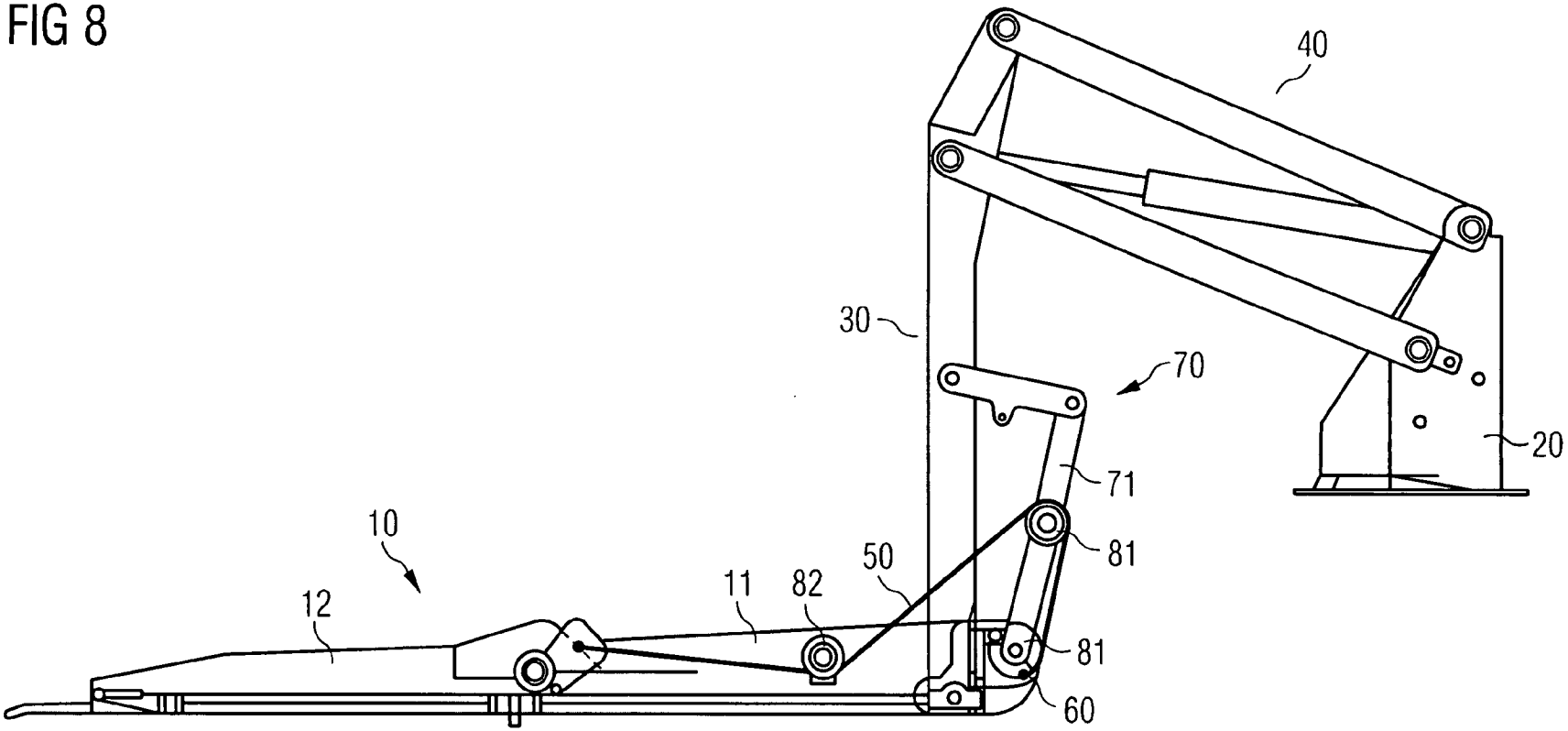
FIG. 8 shows an embodiment of a wheelchair lift with a foldable platform assembly.

FIG. 8 shows another embodiment of the wheelchair lift comprising the power control assembly 20, the holding arm 30 to movably hold the platform 10 and the lifting assembly 40. The linkage assembly 50 is fixed to the outer plate 12 and led via a deflecting unit 82 to the deflecting unit 81. The deflecting unit 82 may be arranged as a pulley and may be mounted to the inner plate 11. The deflecting unit 81 may comprise the deflecting element 811 being coupled to the arm 71 of the elbow assembly 70. The linkage assembly 50 may be deflected at the deflecting element 811 towards the fixing element 60 which may be mounted to the inner plate 11. The fixing element 60 may be fixed to the pivot pin 90 which couples the arm 71 of the elbow assembly 70 to the inner plate 11.

According to another embodiment the deflecting unit 81 comprises the deflecting element 811 coupled to the arm 71 and the deflecting element 812 being fixed to the pivot pin 90. The linkage assembly is deflected at the deflecting element 811 towards the deflecting element 812, and via the deflecting element 812 towards the fixing element 60 which is fixed to the inner plate 11 at a location between the pivot pin 90 and the hinge element 110 at which the inner plate is rotatably coupled to the holding arm 30.

Figure 9:
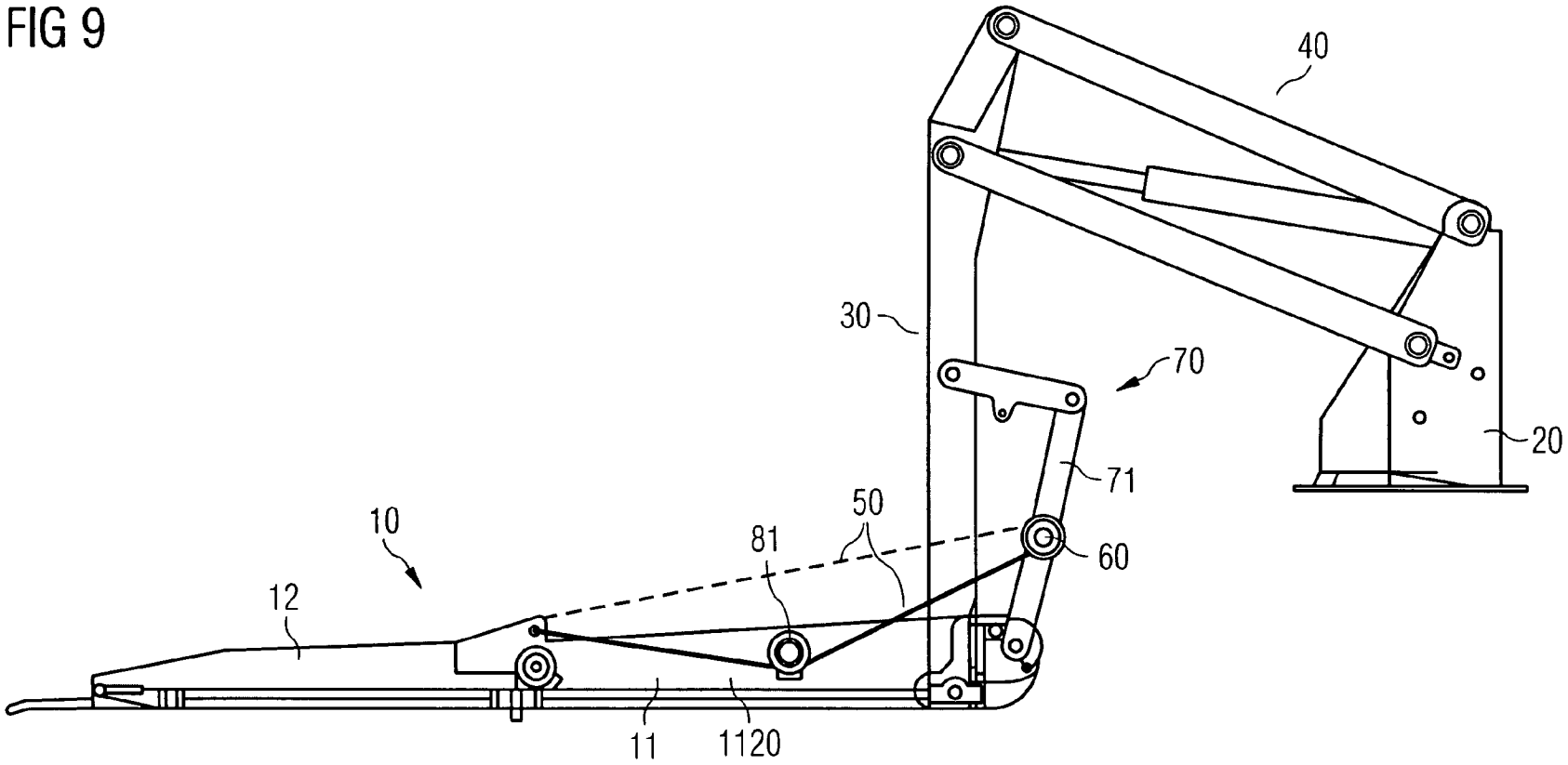
FIG. 9 shows an embodiment of a wheelchair lift with a foldable platform assembly.

FIG. 9 shows another embodiment of the wheelchair lift. The wheelchair lift comprises the platform assembly 10, the power control assembly 20, the holding arm 30 to movably hold the platform 10 and the lifting assembly 40. The linkage assembly 50 is fixed to the outer plate 12 and led from the outer plate 12 via the deflecting unit 81 to the fixing element 60. The deflecting unit 81 may be formed as a pulley and may be mounted to the inner plate 11. The deflecting unit 81 may be mounted to the side panel 1120 of the inner plate 11. The fixing element 60 may be fixed to the arm 71 of the elbow assembly 70.

According to another embodiment the linkage assembly 50 is fixed to the outer plate and is directly led from the outer plate 12 to the fixing element 60 which is fixed to the arm 71 of the elbow assembly. The linkage assembly 50 is shown in FIG. 9 for this embodiment as a dashed line.

The wheelchair lift may be used to lift any load or may operate without being operated with a load. Furthermore, the wheelchair lift can be mounted to any location where it can be moved from the stowed to the unfolded configuration which does not necessarily require mounting to a vehicle.

Many modifications and other embodiments set forth herein will come to mind to one skilled in the art to which the embodiments pertain having the benefit of the teachings presented in the foregoing descriptions and the associated drawings. Therefore, it is to be understood that the description and the claims are not to be limited to the specific embodiments disclosed and that modifications and other embodiments are intended to be included within the scope of the appended claims. It is intended that embodiments cover the modifications and variations of the embodiments provided they come within the scope of the appended claims and their equivalents. Although specific terms are employed herein, they are used in a generic and descriptive sense only and not for purposes of limitation.

LIST OF REFERENCES

1 wheelchair lift
2 floor (entry) level
3 ground level
10 platform assembly
11 inner plate of the platform assembly
12 outer plate of the platform assembly
13 hinge element
20 power control assembly
30 holding arm
40 lifting assembly/parallelogram actuating linkage structure
50 linkage assembly
70 elbow assembly
71, 72 arms of the elbow assembly
73 hinge of the elbow assembly
81, 82 deflecting elements
83 deflecting unit
90 pivot pin
100 arrestor element
110 axis/hinge element
120 supporting element
130 housing
140 further elbow assembly
150 protection element

What is claimed is:

1. A wheelchair lift, comprising:

a platform assembly (10) to receive a wheelchair, a power control assembly (20) to control a movement of the platform assembly (10) between an unfolded configuration and a folded configuration, a holding arm (30) to movably hold the platform assembly (10), said platform assembly (10) comprising an inner plate (11) and an outer plate (12) and a hinge element (110), wherein the inner plate (11) is pivotably coupled to the holding arm (30) by the hinge element (110) and the other plate (12) is pivotably coupled to the inner plate (11), a linkage assembly (50) having a first end (51) coupled to the outer plate (12) and a second end (52), a fixing element (60) of which the movement is coupled to the movement of the inner plate (11) such that the fixing element (60) is moved together with a rotational movement of the inner plate (11) around the hinge element (110) of the platform assembly (10), when the inner plate (11) is moved between the folded and the unfolded configuration, wherein the second end (52) of the linkage assembly (50) is coupled to the fixing element (60), a lifting assembly (40) being connected to the power control assembly (20) and the holding arm (30), an elbow assembly (70) having a first arm (71) coupled to the inner plate (11), a second arm (72) coupled to the holding arm (30), and a hinge element (73) at which the first and the second arm (71, 72) are pivotably connected, wherein the power control assembly (20) is arranged to move the platform assembly (10) from a stowed position in which the inner and outer plates (11, 12) are in the folded configuration to an entry level position in which the inner and outer plates are in the unfolded configuration, and from the entry level position to a ground level position in which the inner and outer plates (11, 12) are in the unfolded configuration and which is below the entry level position, wherein the hinge element (73) of the elbow assembly is coupled to the lifting assembly (40) when moving the platform assembly (10) from the folded configuration to the unfolded configuration, wherein the hinge element (73) of the elbow assembly is decoupled from the lifting assembly (40) when moving the platform assembly (10) from the entry level position to the ground level position, and wherein the linkage assembly (50) is coupled to the first arm (71) of the elbow assembly.

2. The wheelchair lift as claimed in claim 1, wherein the coupling between the inner plate (11) and the fixing element (60) is arranged such that the coupling causes the movement of the fixing element together with the rotational movement of the inner plate.

3. The wheelchair lift as claimed in claim 1, comprising:

at least one first deflecting unit (81) being arranged to deflect the linkage assembly (50) from the outer plate (12) to the fixing element (60).

4. The wheelchair lift as claimed in claim 1, wherein the at least one first deflecting unit (81) comprises a first and a second deflecting element (811, 812), wherein each of the first and second deflecting element (811, 812) is coupled to the first arm (71) of the elbow assembly, wherein the first deflecting element (811) is positioned closer to the hinge element (73) of the elbow assembly (70) than the second deflecting element (812), wherein the linkage assembly (50) is led from the outer plate (12) to the first deflecting element (811), wherein the linkage assembly (50) is deflected at the first deflecting element (811) towards the second deflecting element (812), wherein the linkage assembly (50) is deflected at the second deflecting element (812) towards the fixing element (60), wherein the fixing element (60) is mounted to the inner plate (11).

5. The wheelchair lift as claimed in claim 3, further comprising:

a further elbow assembly (140) having a first arm (141) being pivotably connected to the first arm (71) of the elbow assembly (11), a second arm (142) being pivotably coupled to the second arm (72) of the elbow assembly, and a hinge element (143) at which the first and the second arm (141, 142) of the further elbow assembly are pivotably connected, wherein the at least one first deflecting unit (81) comprises a first and a second deflecting element (811, 812), wherein the first deflecting element (811) is coupled to the hinge element (143) of the further elbow assembly (140), wherein the linkage assembly (50) is led from the outer plate (12) to the first deflecting element (811), wherein the linkage assembly (50) is deflected at the first deflecting element (811) towards the second deflecting element (812), wherein the linkage assembly (50) is deflected at the second deflecting element (812) towards the fixing element (60), and wherein the fixing element (60) is mounted to the inner plate (11).

6. The wheelchair lift as claimed in claim 4, wherein the first arm (71) of the elbow assembly is coupled to the inner plate (11) by a pivot pin (90), wherein the second deflecting element (812) of the at least one first deflecting unit (81) is fixed to the pivot pin (90).

7. The wheelchair lift as claimed in claim 3, wherein the first arm (71) of the elbow assembly is coupled to the inner plate (11) by a pivot pin (90) fixed to the inner plate (11), wherein the at least one first deflecting unit (81) is coupled to the first arm (71) of the elbow assembly (70)

wherein the fixing element (60) is fixed to the pivot pin (90), wherein the linkage assembly (50) is led from the outer plate (12) to the at least one first deflecting unit (81), wherein the linkage assembly (50) is deflected at the first deflecting unit (81) towards the fixing element (60).

8. The wheelchair lift as claimed in claim 3, further comprising:

a further elbow assembly (140) having a first arm (141) being pivotably connected to the first arm (71) of the elbow assembly (11), a second arm (142) being pivotably coupled to the second arm (72) of the elbow assembly, and a hinge element (143) at which the first and the second arm (141, 142) of the further elbow assembly are pivotably connected, wherein the first arm (71) of the elbow assembly is coupled to the inner plate (11) by a pivot pin (90) fixed to the inner plate (11), wherein the at least one first deflecting unit (81) is coupled to the hinge element (143) of the further elbow assembly (140), wherein the fixing element (60) is fixed to the pivot pin (90), wherein the linkage assembly (50) is led from the outer plate (12) to the at least one first deflecting unit (81), wherein the linkage assembly (50) is deflected at the first deflecting unit (81) towards the fixing element (60).

9. The wheelchair lift as claimed in claim 6, comprising:

at least one second deflecting unit (82) being movably coupled to the inner plate (11) to deflect the linkage assembly (50) from the outer plate (12) to the at least one first deflecting unit (81), wherein the at least one second deflecting unit (82) is arranged such that the at least one second deflecting unit (82) is moved relative to the inner plate (11), when the platform assembly is moved between the folded and unfolded configuration.

10. The wheelchair lift as claimed in claim 3, comprising:

at least one second deflecting unit (82) being mounted to the inner plate (11) to deflect the linkage assembly (50) from the outer plate (12) to the at least one first deflecting unit (81).

11. The wheelchair lift as claimed in claim 3, wherein the at least one first deflecting unit (81) is mounted to the inner plate (11), wherein the linkage assembly (50) is led from the outer plate (12) to the at least one first deflecting unit (81), wherein the linkage assembly (50) is deflected at the first deflecting unit (81) towards the fixing element (60), wherein the fixing element (60) is fixed to the first arm (71) of the elbow assembly (70).

12. The wheelchair lift as claimed in claim 1, wherein the linkage assembly (50) comprises one of a rope and a chain and rigid elements, preferably made of metal, most preferably made of steel or an aramide fiber or an aramide fiber composition, wherein the at least one first and second deflecting unit (81, 82) comprises at least one pulley (811, 812, 82).

13. The wheelchair lift as claimed in claim 1, wherein the fixing element (60) is fixed to the first arm (71) of the elbow assembly (70).

* * * * *